US005408929A

United States Patent [19]

Rodi

[11] Patent Number: 5,408,929

[45] Date of Patent: Apr. 25, 1995

[54] INK DUCT FOR OFFSET OR LETTERPRESS PRINTING MACHINES

[75] Inventor: Anton Rodi, Leimen, Germany

[73] Assignee: Heidelberger Druckmaschinen AG, Heidelberg, Germany

[21] Appl. No.: 165,978

[22] Filed: Dec. 13, 1993

[30] Foreign Application Priority Data

Dec. 11, 1992 [DE] Germany ..... 42 41 808.9

[51] Int. Cl.[6] ..... B41F 31/04; B41F 31/06

[52] U.S. Cl. ..... 101/365

[58] Field of Search ..... 101/365, 350, 363, 148, 101/366; 118/261

[56] References Cited

U.S. PATENT DOCUMENTS 4,242,958 1/1981 Jeschke ..... 101/365
4,480,547 11/1984 Jeschke et al. .
4,495,864 1/1985 Junghans .
4,729,312 3/1988 Rodi et al. ..... 101/350

FOREIGN PATENT DOCUMENTS 1208071 3/1992 Canada .
0223972 2/1991 European Pat. Off. .
3203500 8/1983 Germany .
3336705 5/1984 Germany .
2156276 10/1985 United Kingdom .

*Primary Examiner*—J. Reed Fisher
*Attorney, Agent, or Firm*—Herbert L. Lerner; Laurence A. Greenberg

[57] ABSTRACT

Ink duct for offset or letterpress printing machines having an ink-metering device by which a respective ink gap is adjustable zonewise in axial direction of an ink-duct roller, wherein the ink-metering device includes metering elements and an elastic foil covering the metering elements, the metering elements having a region of supporting webs and being pressable against the ink-duct roller through the intermediary of the elastic foil, a foil-holding device for holding the elastic foil so that it is displaceable tangentially with respect to the ink-duct roller in a given feeding direction, and a motor-driven actuating device connected to the foil-holding device for continuously feeding the elastic foil in the given feeding direction, the elastic foil being formed with low-wear zones extending in the given feeding direction of the elastic foil and covering the region of supporting webs of the metering elements.

8 Claims, 2 Drawing Sheets

INK DUCT FOR OFFSET OR LETTERPRESS PRINTING MACHINES

SPECIFICATION

The invention relates to an ink duct for offset or letter-press printing machines having an ink-metering device by which a respective ink gap is adjustable zonally or zonewise in axial direction of an ink-duct roller, the ink-metering device having metering elements pressable against the ink-duct roller through the intermediary of a foil covering the elements, foil-holding means for holding the foil so that it is displaceable tangentially with respect to the ink-duct roller, and motor-driven actuating means connected to the foil-holding means for continuously feeding the foil.

An ink duct for offset or letterpress printing machines has become known heretofore, for example, from the published European Patent Document 0 223 972 Bl corresponding to U.S. Pat. No. 4,729,312. The device described therein permits the movement of a foil across an ink-duct base, so that, at a contact location between a rotating ink-duct roller and the foil, which is pressed against the roller by metering elements, respective new regions of the foil having undiminished material properties always come into contact with the ink-duct roller. In order to ensure a continuous feeding of the foil, a winding spindle provided with a defined supply of foil is connected via a gear drive with a motor drive which transports farther onward the used foil region, which has been disposed in the contact region of the foil with the ink-duct roller, after the service life of that foil region been exhausted, until a new unused foil region is present at the contact location of the foil with the ink-duct roller. That part of the foil containing the used foil regions which are successively moved out of the contact-location region is taken up by a spindle, also.

The device of the aforementioned published European Patent Document requires a disadvantageously great mechanical effort in order to displace the foil. Furthermore, it is always necessary to have a defined supply of foil on the winding spindle of the heretofore known device, even though that supply of foil may not be required for a specific period of time. Should there be a change in the spacing or distance between the ink-duct roller and the metering element due to excessive wear of material on the foil in the region of the contact location thereof with the ink-duct roller, the previously set zonewise or zonal inking may also change.

Starting from the teachings of the prior art as outlined hereinbefore, it is an object of the invention to provide an ink duct for offset and letterpress printing machines with ink-duct foils having a greater service life than heretofore possible.

With the foregoing and other objects in view, there is provided, in accordance with the invention, an ink duct for offset or letterpress printing machines having an ink-metering device by which a respective ink gap is adjustable zonewise in axial direction of an ink-duct roller, the ink-metering device comprising metering elements and an elastic foil covering the metering elements, the metering elements having a region of supporting webs and being pressable against the ink-duct roller through the intermediary of the elastic foil, foil-holding means for holding the elastic foil so that it is displaceable tangentially with respect to the ink-duct roller in a given feeding direction, and motor-driven actuating means connected to the foil-holding means for continuously feeding the elastic foil in the given feeding direction, the elastic foil being formed with low-wear zones extending in the given feeding direction of the elastic foil and covering the region of supporting webs of the metering elements.

An advantage of this construction according to the invention is that the wear characteristics of the foil in the ink duct are locally improved without negatively influencing the elastic properties of remaining foil regions. The improved wear characteristics in the contact-pressure region between the foil and the ink-duct roller, moreover, ensure the maintenance of the once-selected spacing or distance between the metering elements and the ink-duct roller, so that the zonally set ink profile across the entire ink-duct width is not subject to any changes that might be caused, for example, by a worn foil section in the contact region of the foil with the ink-duct roller.

In accordance with another feature of the invention, the ink duct has a zonal subdivision, and the low-wear zones extend across the width of the elastic foil in accordance with the zonal subdivision of the ink duct.

In accordance with a further feature of the invention, the low-wear zones are applied to a side of the elastic foil facing towards the ink-duct roller.

Thus, the ink-duct foil according to the invention can be adapted to ink ducts of all commonly used classes of sheet size or format in printing-machine construction. Because only those regions of the ink-duct foil exposed to the highest mechanical stresses are especially influenced, the elastic properties of the foil in the vicinity of the cutouts or recesses formed in the metering elements can be fully maintained. This ensures a precise control of the ink flow according to the position of the respective metering element, with a clearly increased service life of the ink-duct foil.

In accordance with a first alternative feature of the invention, the low-wear zones are formed of metal strips vapor-deposited on the elastic foil.

In accordance with a second alternative feature of the invention, the low-wear zones are ceramic-coated.

In accordance with a third alternative feature of the invention, the low-wear zones are formed of adamantine carbon.

In accordance with a concomitant alternative feature of the invention, the low-wear zones of the elastic foil are formed of plastic material reinforced by carbon fibers.

Other features which are considered as characteristic for the invention are set forth in the appended claims.

Although the invention is illustrated and described herein as embodied in an ink duct for offset or letterpress printing machines, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
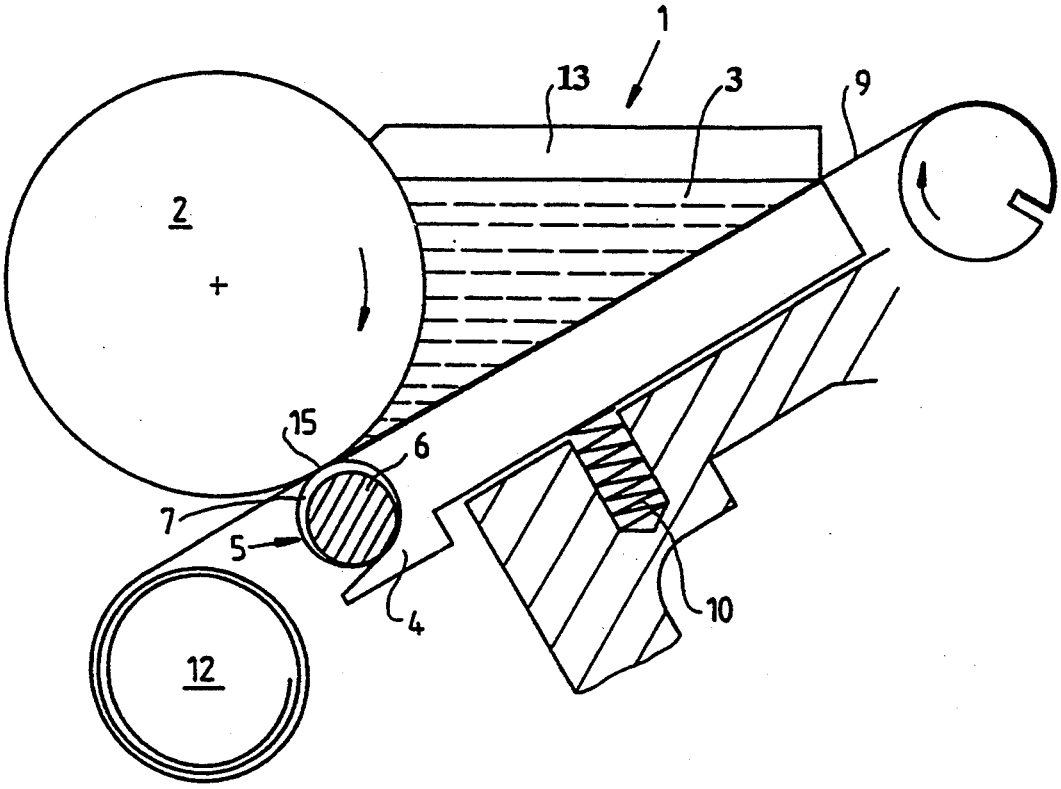
FIG. 1 is a diagrammatic cross-sectional view of an ink duct with an ink-duct roller.

Referring now to the drawings and, first, particularly to FIG. 1 thereof, there is shown therein, in a diagrammatic cross-sectional view, an ink duct 1 with an ink-duct roller 2.

The ink duct 1 is bounded by the ink-duct roller 2 as well as laterally disposed side jaws 13. The ink duct 1 has a base formed by a pressure bar 4. An elastic foil 9, wound on two spindles in the illustrated embodiment, extends between the pressure bar 4 and an ink supply 3. The pressure bar 4 is pressed from below against the elastic foil 9 through the intermediary of a compression spring 10, which is accommodated in a recess formed in a cross-member which is illustrated diagrammatically in FIG. 1. An ink-metering device is provided at the lower end of the pressure bar 4, and includes juxtaposed metering elements 6, extending across the width of the ink duct 1 (note FIG. 2). Each of the metering elements 6 is formed with a cutout 7 which, depending upon the rotary position thereof relative to the ink-duct roller 2, defines the ink flow through a gap produced between the ink-duct roller 2 and the metering element 6. The rotary position of the individual metering elements 6 is realized by servo-motors, each of which is associated with a respective metering element 6, but does form any part of the subject matter of the invention of the instant application.

The elastic foil 9, a supply of which is carried on a supply coil 12, is pressed against the ink-duct roller 2 by the metering elements 6 at a contact location 15, thereby subjecting the elastic foil 9 to high mechanical stresses.

Figure 2:
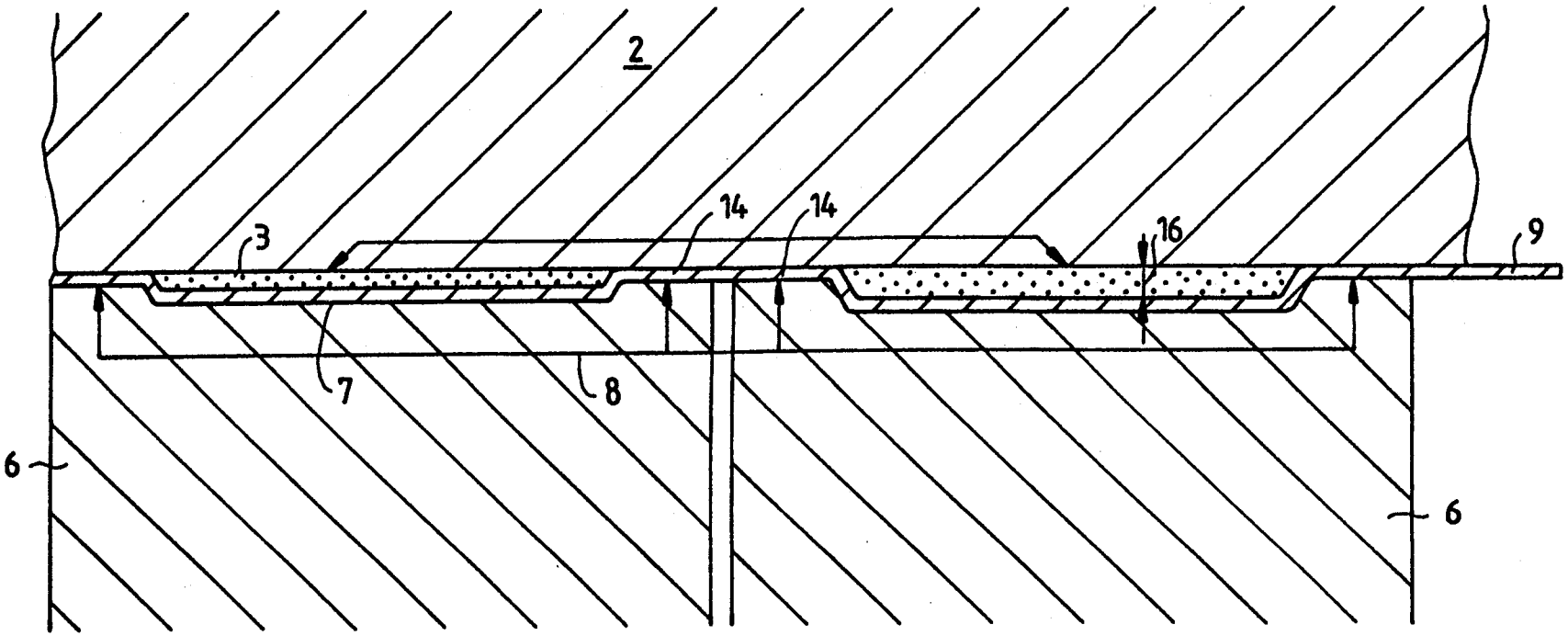
FIG. 2 is a fragmentary much-enlarged view of FIG. 1 showing in detail a location of contact between the ink-duct roller and an ink-duct foil, the ink-duct foil having been deformed by the manner in which respective metering elements have been disposed.

In the enlarged fragmentary view of the contact location 15 between the ink-duct roller 2 and the elastic foil 9, as shown in FIG. 2, the elastic foil 9 has been deformed in accordance with the rotary positioning of the respective metering elements 6.

The cutouts 7 are formed eccentrically in the individual metering elements 6 and extend annularly over the circumference of the metering elements 6. Each cutout 7 of the respective metering elements 6 is bounded by two supporting webs 8. The metering elements 6 are braced against the ink-duct roller 2 by the supporting webs 8 and the elastic foil 9 snugly adhering to or hugging the outline of the cutout 7. Because the ink-duct roller 2 is conceived to be in constant rotation, regions of the foil 9 which are in contact with the ink-duct roller 2, namely low-wear zones 14, are subject to the highest mechanical stresses. The elastic foil 9 according to the invention is provided, in the region of the low-wear zones 14, with a metallized coating having excellent wearing properties. Instead of a vapor-deposited metallized layer, it would also be conceivable to provide metal strips recessed into the elastic foil 9, or a ceramic coating. A further possible construction of the low-wear zones 14 would entail the use of adamantine or diamond-type carbon, or an elastic foil 9 in the form of a plastic layer reinforced with carbon fibers in the region of the low-wear zones 14.

The service life of the elastic foil 9 is thus able to be lengthened decisively without adversely affecting the elastic properties thereof. As is apparent from FIG. 2, the requirements with regard to the elasticity of the elastic foil 9 are very high because, for example, the widths 16 of the respective ink gaps of the metering elements 6 are, in this case, different. Accordingly, the elastic properties of the foil 9 must permit the elastic foil 9 to adapt to any possible position of the cutout 7, between the individual strip-shaped low-wear zones 14. Because the low-wear zones 14 in contact with the ink-duct roller 2 are not subject to any wear, no changes in the spacing between the supporting webs 8 of the metering elements 6 and the ink-duct roller 2 result due to a reduction in the thickness of the foil 9 in the region of the contact locations. Therefore, the thickness of the ink gap 16, once it has been precisely set for each metering element 6, remains constant.

Figure 3:
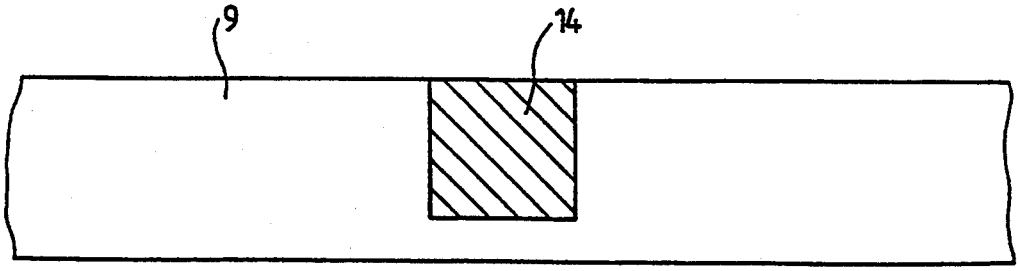
FIG. 3 is a fragmentary further-enlarged longitudinal sectional view of FIG. 2 showing a detail of the elastic ink-duct foil.

FIG. 3 is an enlarged fragmentary view of the elastic foil 9. In this illustrated embodiment of the foil 9, the low-wear zones 14 are formed, for example, by individual metal strips extending longitudinally in the feeding direction of the elastic foil 9, and by which the elastic foil is supported on the ink-duct roller 2. The considerably extended service life of the ink-duct foil due to its having been formed from the elastic foil 9 with low-wear zones 14, makes a drive for feeding the foil 9 superfluous. Once installed, the ink-duct foil thus remains in the ink duct 1 throughout the entire service life of the rotary printing machine.

I claim:

1. Ink duct for offset or letterpress printing machines having an ink-metering device by which a respective ink gap is adjustable zonally in axial direction of an ink-duct roller, the ink-metering device comprising metering elements and an elastic foil covering said metering elements, said metering elements having a region of supporting webs and being pressable against the ink-duct roller through the intermediary of said elastic foil, and foil-holding means for holding said elastic foil so that it is displaceable tangentially with respect to the ink-duct roller in a given feeding direction, said elastic foil having low-wear zones formed thereon having improved wear characteristics as compared to zones of said elastic foil between said low-wear zones, said low-wear zones extending in said given feeding direction of said elastic foil and covering said region of supporting webs of said metering elements.

2. Ink duct according to claim 1, wherein the ink duct has a zonal subdivision, and said low-wear zones extend across the width of said elastic foil in accordance with the zonal subdivision of the ink duct.

3. Ink duct according to claim 1, wherein said low-wear zones are disposed on a side of said elastic foil facing towards said ink-duct roller.

4. Ink duct according to claim 1, wherein said low-wear zones are metal strips vapor-deposited on said elastic foil.

5. Ink duct according to claim 1, wherein said low-wear zones are ceramic-coated.

6. Ink duct according to claim 1, wherein said low-wear zones carry adamantine carbon.

7. Ink duct according to claim 1, wherein said low-wear zones of said elastic foil are plastic material reinforced by carbon fibers.

8. Ink duct according to claim 1, which further comprises motor-driven actuating means connected to said foil-holding means for continuously feeding said elastic foil in said given feeding direction.

* * * * *